US007997577B2

(12) United States Patent
Oshiro et al.

(10) Patent No.: US 7,997,577 B2
(45) Date of Patent: Aug. 16, 2011

(54) PIVOTING SHEET DISCHARGING TRAY AND IMAGE FORMING APPARATUS INCLUDING THE TRAY

(75) Inventors: Toshiaki Oshiro, Shizuoka-Ken (JP); Hiroyuki Taki, Shizuoka-Ken (JP); Yasunobu Terao, Shizuoka-Ken (JP); Isao Yahata, Shizuoka-Ken (JP); Tomomi Iijima, Shizuoka-Ken (JP); Shoichi Dobashi, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 54 days.

(21) Appl. No.: 12/403,940

(22) Filed: Mar. 13, 2009

(65) Prior Publication Data

US 2009/0230612 A1 Sep. 17, 2009

Related U.S. Application Data

(60) Provisional application No. 61/036,449, filed on Mar. 13, 2008, provisional application No. 61/036,454, filed on Mar. 13, 2008, provisional application No. 61/061,998, filed on Jun. 16, 2008, provisional application No. 61/081,693, filed on Jul. 17, 2008.

(51) Int. Cl.
*B65H 31/04* (2006.01)

(52) U.S. Cl. ..... 271/213; 270/59

(58) Field of Classification Search ..... 271/213, 271/214, 215, 217; 414/788.9, 789.1; 270/58.13, 270/59, 58.01, 58.07, 58.08, 58.11, 58.12, 270/58.17, 58.28, 58.27

See application file for complete search history.

(56) References Cited

U.S. PATENT DOCUMENTS

| | | | | |
|---|---|---|---|---|
| 5,350,169 | A * | 9/1994 | Hiroi et al. | 271/213 |
| 5,984,299 | A * | 11/1999 | Hirota et al. | 271/161 |
| 6,515,735 | B2 * | 2/2003 | Takoh | 355/72 |
| 6,663,102 | B2 * | 12/2003 | Takahashi et al. | 271/217 |
| 7,185,884 | B2 * | 3/2007 | Terao et al. | 270/58.14 |
| 7,584,958 | B2 * | 9/2009 | Ficarra et al. | 271/213 |
| 7,853,192 | B2 * | 12/2010 | Nagao et al. | 399/405 |
| 2006/0019811 | A1 | 1/2006 | Ikeda et al. | |
| 2006/0066037 | A1 | 3/2006 | Terao et al. | |
| 2006/0066039 | A1 | 3/2006 | Terao et al. | |
| 2006/0066040 | A1 | 3/2006 | Terao et al. | |
| 2006/0067762 | A1 | 3/2006 | Terao et al. | |
| 2007/0057435 | A1 | 3/2007 | Terao et al. | |

FOREIGN PATENT DOCUMENTS

| | | | |
|---|---|---|---|
| JP | 63066060 | A * | 3/1988 |
| JP | 3-152058 | A | 6/1991 |
| JP | 6-161181 | A | 6/1994 |
| JP | 2004-99236 | A | 4/2004 |
| JP | 7-257801 | A | 10/2005 |
| JP | 2007-084186 | A | 4/2007 |
| JP | 2007-176676 | A | 7/2007 |

* cited by examiner

*Primary Examiner* — Jeremy Severson
(74) *Attorney, Agent, or Firm* — Patterson & Sheridan, LLP

(57) ABSTRACT

An image forming apparatus including a sheet loader, the sheet loader including: a discharger configured to discharge a first sheet and a second sheet after the first sheet; a tray configured to support the second sheet on the first sheet; a support configured to support the first sheet on the tray; a controller configured to control the support to lower a first angle than a second angle, the first angle being an angle of the first sheet against a direction to which the discharger discharges the second sheet at a position where the second sheet hits on the first sheet, the second angle being an angle of the tray against the direction at a position where the first sheet hits on the tray.

12 Claims, 20 Drawing Sheets

PIVOTING SHEET DISCHARGING TRAY AND IMAGE FORMING APPARATUS INCLUDING THE TRAY

CROSS-REFERENCE TO RELATED APPLICATIONS

This application is based upon and claims the benefit of priority from: U.S. provisional application 61/036,449, filed on Mar. 13, 2008; U.S. provisional application 61/036,454, filed on Mar. 13, 2008; U.S. provisional application 61/061,998, filed on Jun. 16, 2008; and U.S. provisional application 61/081,693, filed on Jul. 17, 2008, the entire contents of each of which are incorporated herein by reference.

TECHNICAL FIELD

Described herein relates to a sheet loader and an image forming apparatus, and, more particularly to a sheet loader and an image forming apparatus capable of preventing occurrence of a paper jam between sheets put on standby on standby trays.

BACKGROUND

Recently, an image forming apparatus of an electrophotographic system such as a laser printer, a digital copying machine, or a laser facsimile includes a post-process apparatus (a finisher) that staples a sheet bundle. The finisher includes a stapler for stapling the sheet bundle. The finisher in the past includes, on an upstream side in a sheet conveying direction of a process tray, standby trays for temporarily storing sheets. The standby trays temporarily store (buffer) one to several sheets while the finisher staples sheets on the process tray. The standby trays temporarily store (buffer) one to several sheets while the finisher sorts sheets on the process tray.

However, when the finisher puts sheets on standby on the standby trays, it is also likely that the finisher further puts another sheet on standby on top of a sheet already put on standby on the standby trays. When friction between the sheet already put on standby on the standby trays and the sheet put on standby on top of the sheet is large or when a contact angle between the sheets is large, a paper jam occurs.

SUMMARY

Described herein relates to a sheet loader including: a discharger configured to discharge a first sheet and a second sheet after the first sheet; a tray configured to support the second sheet on the first sheet; a support configured to support the first sheet on the tray; a controller configured to control the support to lower a first angle than a second angle, the first angle being an angle of the first sheet against a direction to which the discharger discharges the second sheet at a position where the second sheet hits on the first sheet, the second angle being an angle of the tray against the direction at a position where the first sheet hits on the tray.

Described herein relates to an image forming apparatus including a sheet loader, the sheet loader including: a discharger configured to discharge a first sheet and a second sheet after the first sheet; a tray configured to support the second sheet on the first sheet; a support configured to support the first sheet on the tray; a controller configured to control the support to lower a first angle than a second angle, the first angle being an angle of the first sheet against a direction to which the discharger discharges the second sheet at a position where the second sheet hits on the first sheet, the second angle being an angle of the tray against the direction at a position where the first sheet hits on the tray.

DETAILED DESCRIPTION

Embodiments of the present invention are explained below with reference to the accompanying drawings.

The entire disclosures of U.S. Pat. No. 7,043,192 filed on Dec. 10, 2004, U.S. Pat. No. 7,206,542 filed on Dec. 10, 2004, U.S. Pat. No. 7,406,293 filed on Dec. 10, 2004, U.S. Pat. No. 7,159,860 filed on Dec. 10, 2004, and U.S. Pat. No. 7,215,922 filed on Dec. 10, 2004 including specifications, claims and summaries are incorporated herein by reference in their entireties.

First Embodiment

Figure 1:
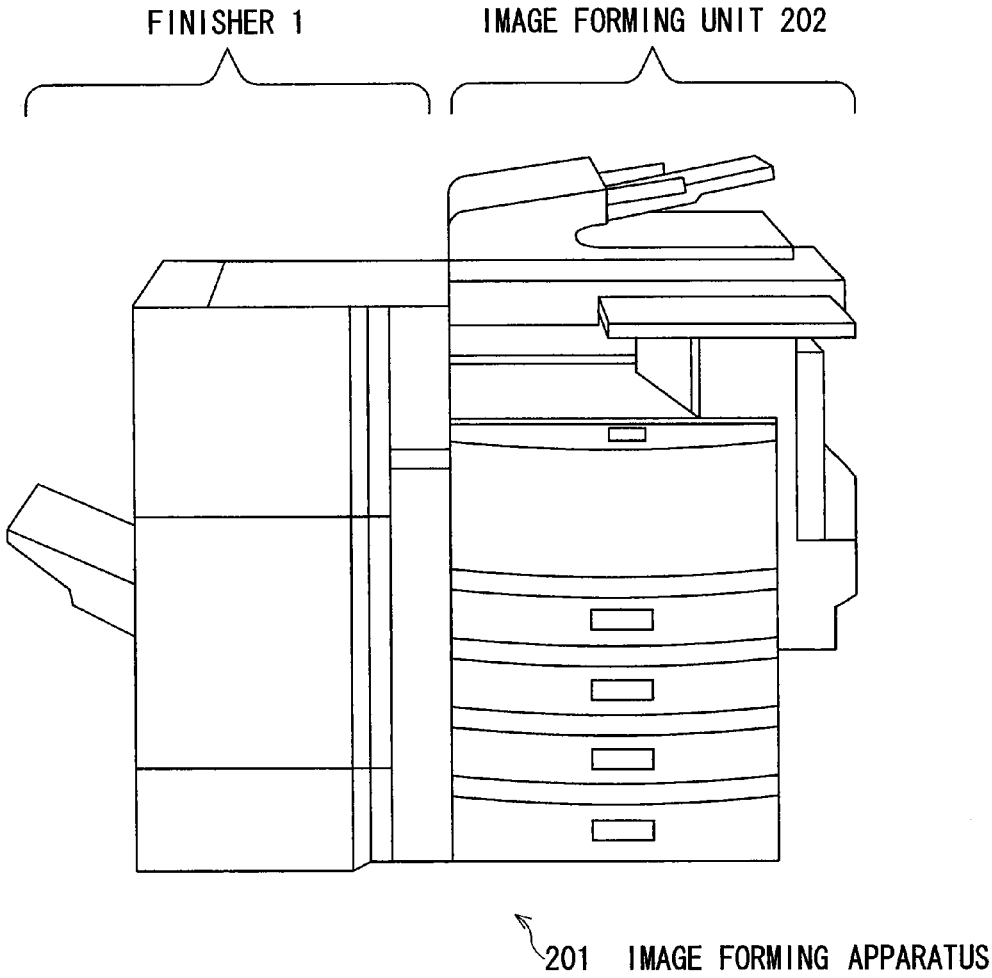
FIG. 1 is a diagram illustrating an entire image forming apparatus according to an embodiment.

FIG. 1 is a diagram illustrating an entire image forming apparatus 201 according to the embodiment. As FIG. 1 shows, the image forming apparatus has an image forming unit 202 and a finisher 1.

Figure 2:
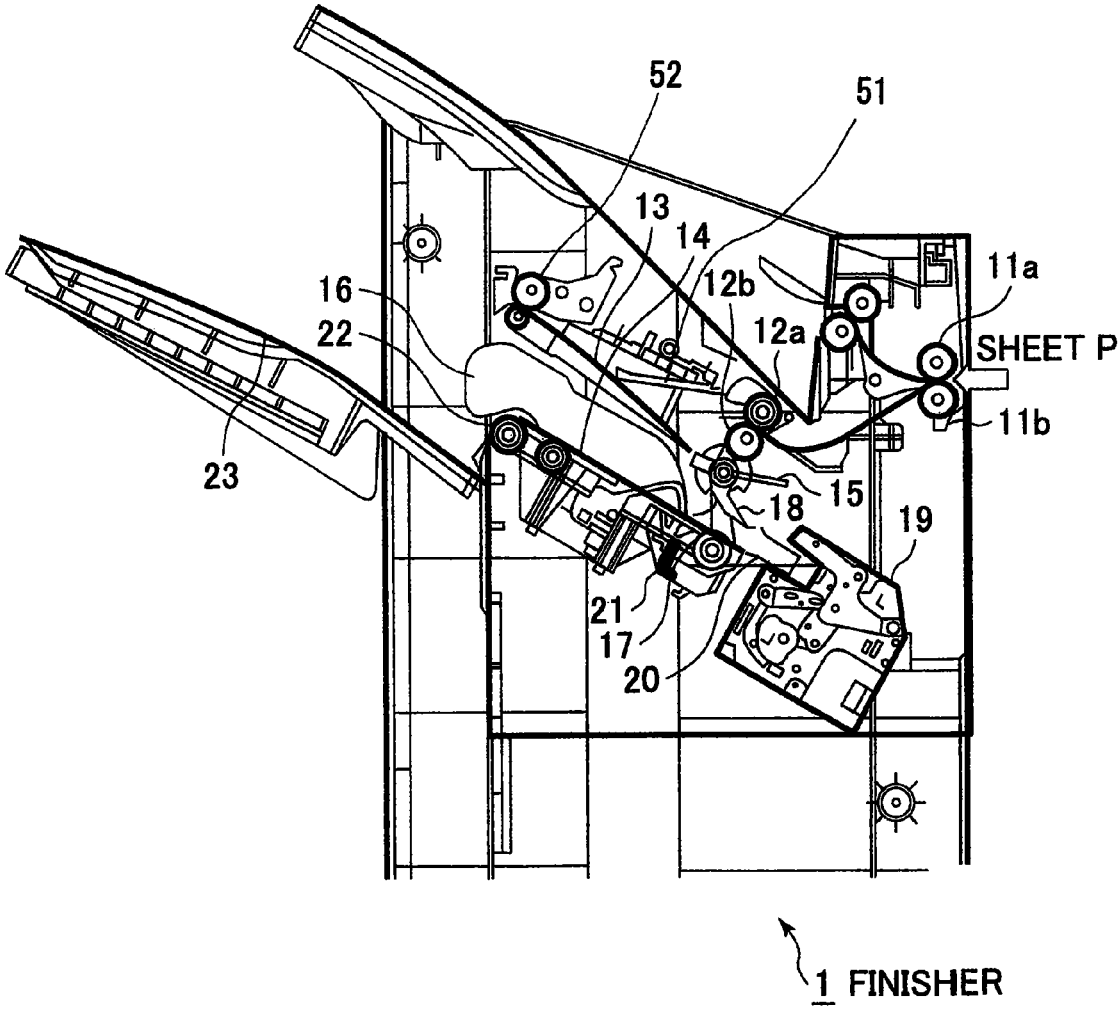
FIG. 2 is a diagram of a configuration of a finisher according to an embodiment.

FIG. 2 is a diagram of a configuration of a finisher (a post-process apparatus) 1 according to an embodiment. Entry rollers 11*a* and 11*b* are a pair of rollers and receive a sheet P supplied from an image forming unit 202 provided on the outside of the finisher 1. The entry rollers 11*a* and 11*b* convey the received sheet P to exit rollers 12*a* and 12*b*. Standby trays 13 temporarily store the sheet P conveyed from the exit rollers 12*a* and 12*b*. The finisher 1 opens the standby trays 13 and drops and supplies the temporarily stored sheet P to a process tray 14. A sheet guide 18 guides the trailing end of the sheet P on the process tray 14, to a stapler 19. Lateral alignment plates 16 laterally align the sheet P on the process tray 14. A paddle 15 and longitudinal alignment rollers 17 strike the trailing end of the sheet P on the process tray 14 against a rear stopper 26 and longitudinally align the sheet P. The paddle 15 includes a long paddle 15*a* and a short paddle 15*b*. The standby trays 13 have movable guides 51 including a movable fulcrum. The finisher 1 has pivoting rollers 52.

Figure 3:
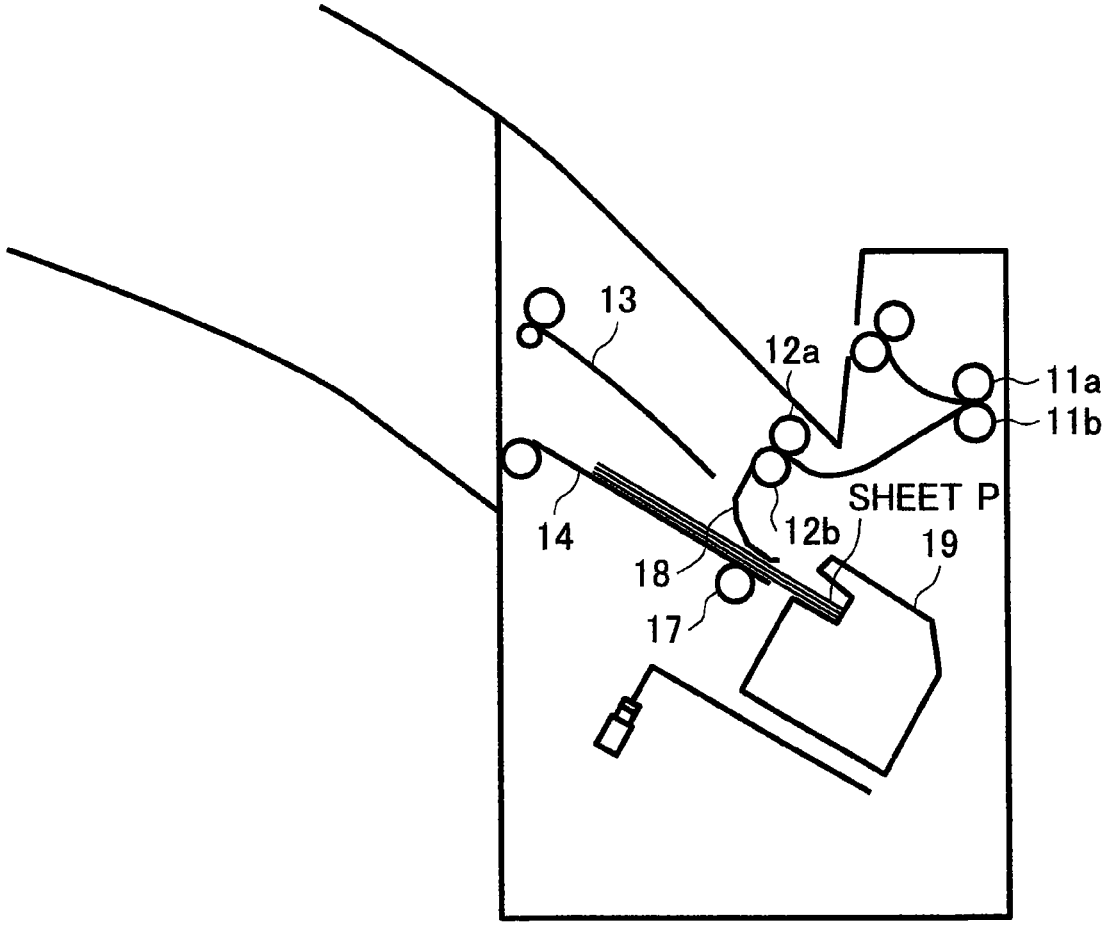
FIG. 3 is a diagram of a state in which the finisher guides a sheet bundle to a stapler after the finisher sequentially guides the sheet bundle to a process tray through standby trays.

As FIG. 3 shows, the finisher 1 sequentially guides sheets P to the process tray 14 through the standby trays 13 and, thereafter, guides sheets P to the stapler 19 by the process explained above. The sheet guide 18 moves to increase a space between the sheet guide 18 and the process tray 14. If the finisher 1 guides the sheet P of the last page to the stapler 19, the stapler 19 staples a sheet bundle of the sheets P. Ejectors 20 have eject arms. The ejectors 20 push out the sheet bundle stapled by the stapler 19 in the direction of a stacking tray 23 and pass the sheet bundle to a bundle pawl belt 21. The bundle pawl belt 21 has a bundle pawl 21*a*. The bundle pawl belt 21 catches the sheet bundle with a bundle pawl 21*a* and discharges the sheet bundle to the stacking tray 23 in association with a discharge operation by discharge rollers 22. A bundle pawl motor that drives the bundle pawl belt 21 drives the ejectors 20 via an electromagnetic spring clutch. If the electromagnetic spring clutch is turned on, the electromagnetic spring clutch transmits driving force of the bundle pawl motor to the ejectors 20.

Figure 4:
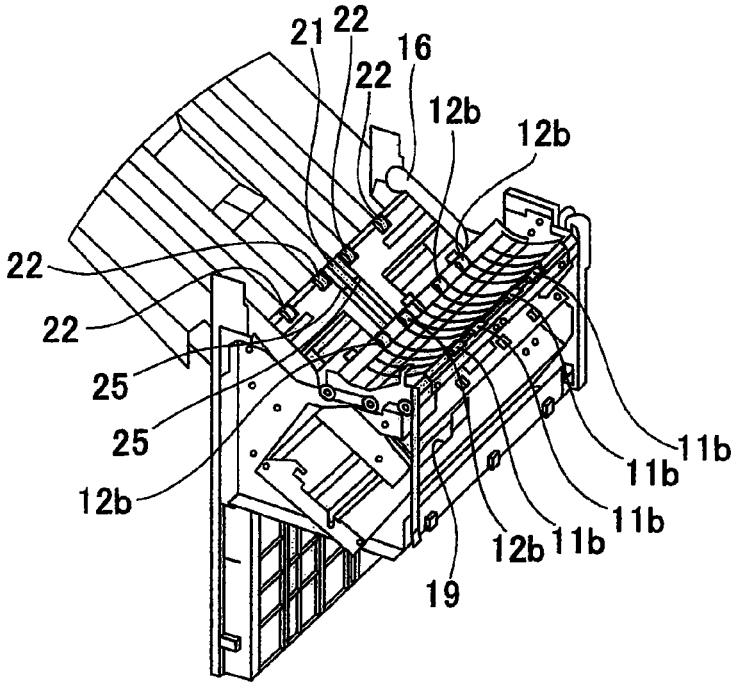
FIG. 4 is a perspective view of the finisher shown in FIG. 2.
Figure 5:
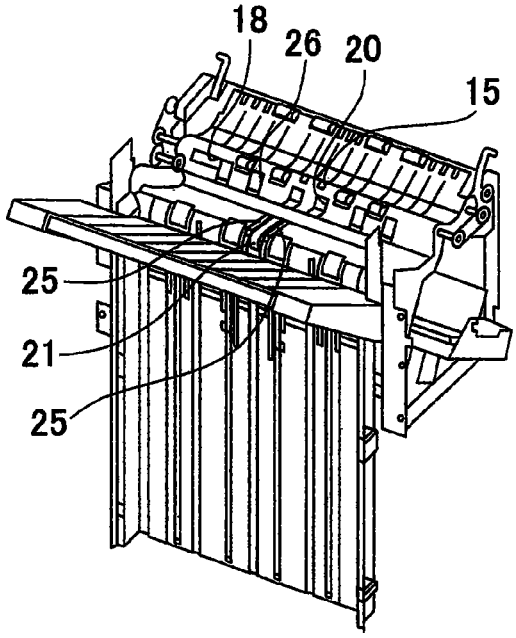
FIG. 5 is another perspective view of the finisher shown in FIG. 2.
Figure 6:
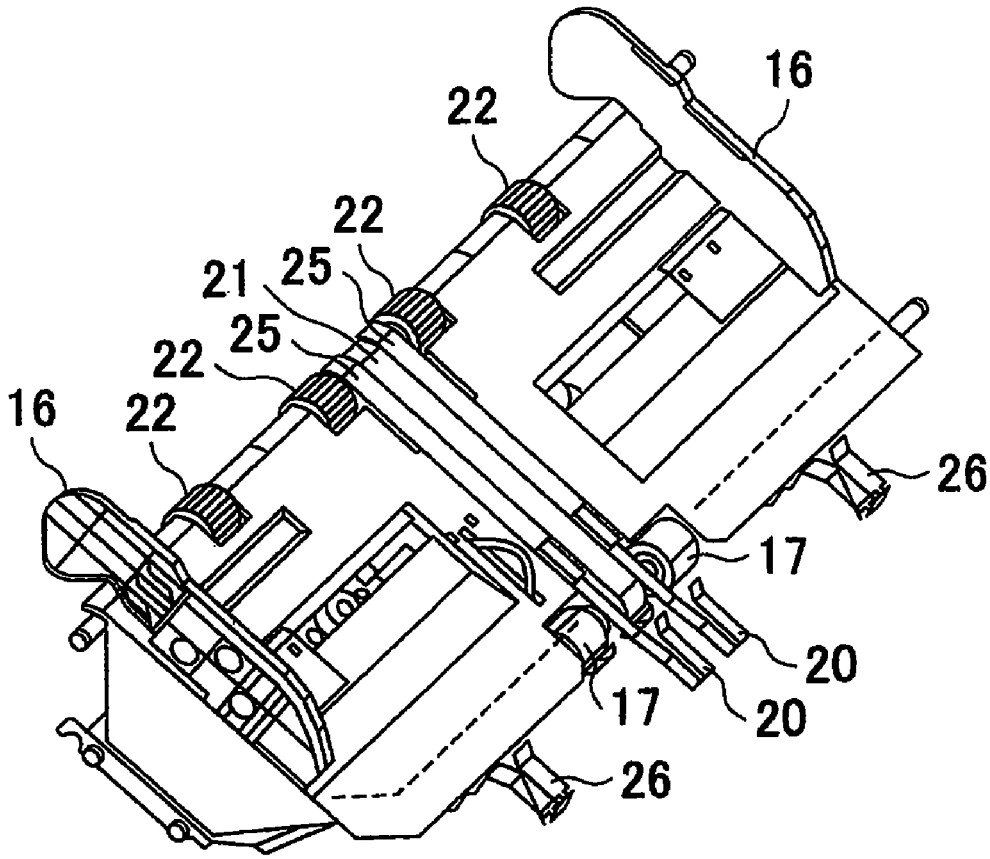
FIG. 6 is still another perspective view of the finisher shown in FIG. 2.
Figure 7:
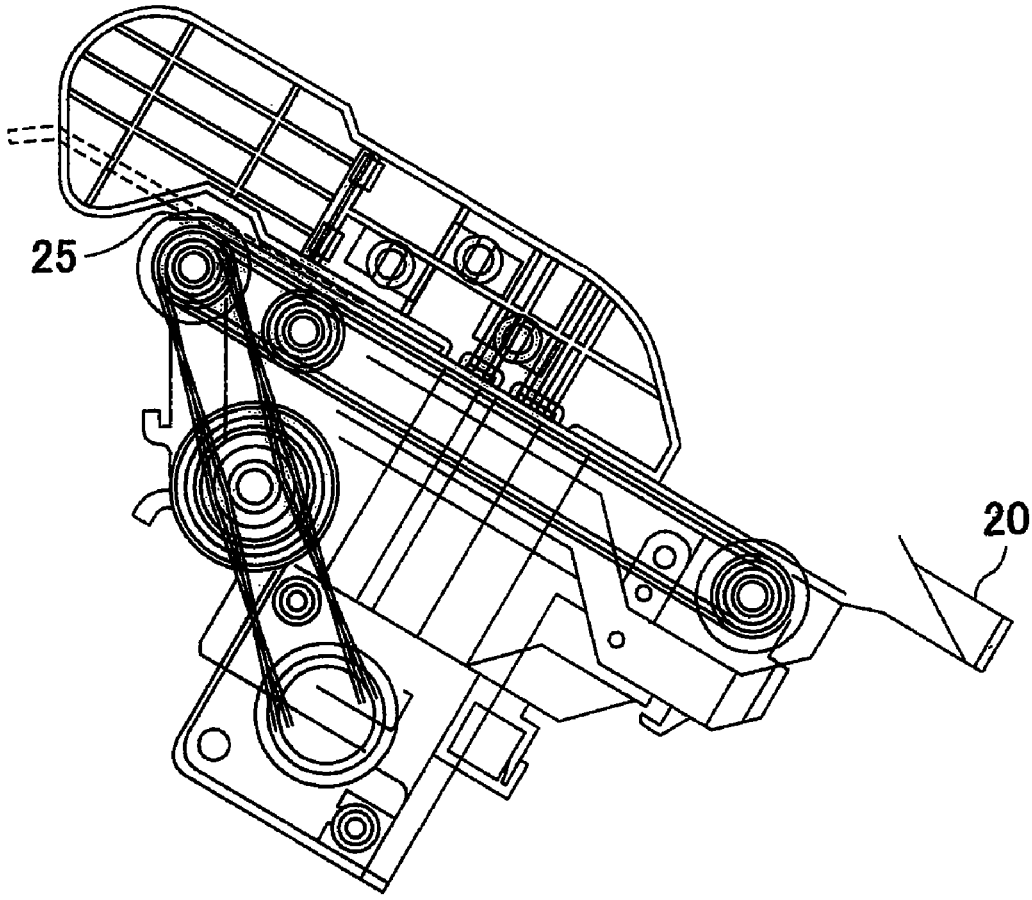
FIG. 7 is a sectional view of the finisher shown in FIG. 2.
Figure 8:
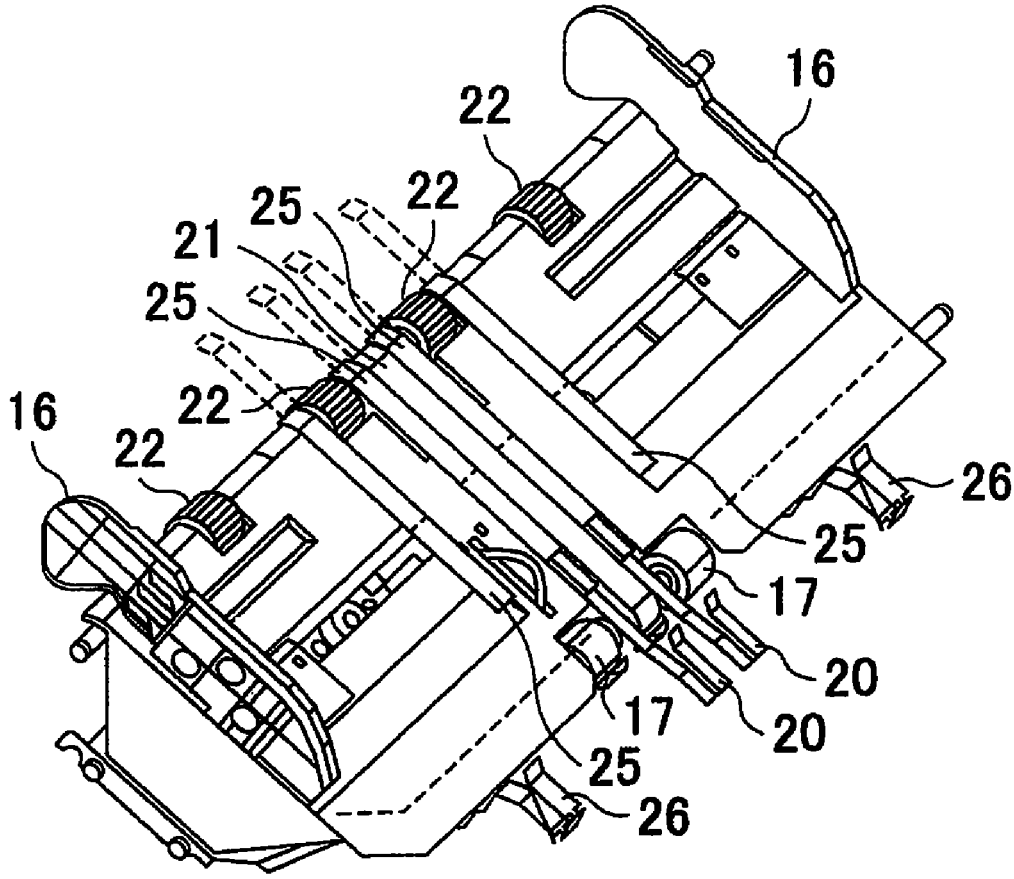
FIG. 8 is still another perspective view of the finisher shown in FIG. 2.

FIGS. 4 to 6 are perspective views of the finisher 1. Push rods 25 integrally form with the ejectors 20. Resin bonds to the distal ends of the push rods 25. FIG. 7 is a sectional view of the finisher 1. The finisher 1 shown in FIGS. 3 to 6 has two push rods 25. On the other hand, the finisher 1 shown in FIG. 8 has four push rods 25.

Figure 9:
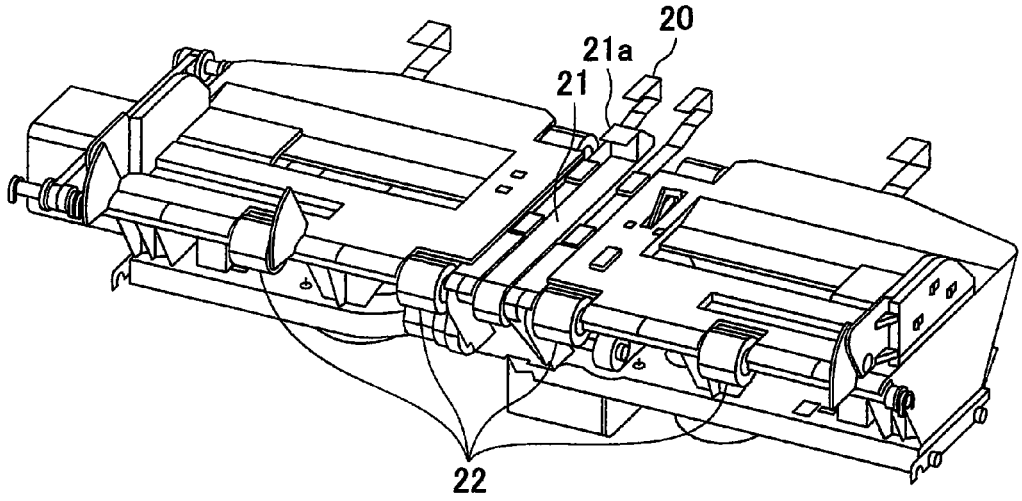
FIG. 9 is a diagram for explaining a discharge operation for a sheet bundle in the finisher.
Figure 10A:
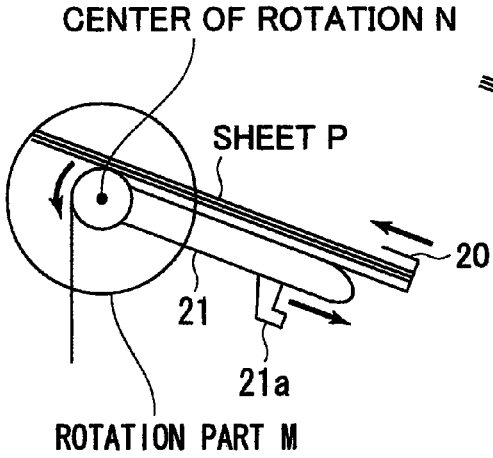
FIGS. 10A and 10B are diagrams for explaining the discharge operation for a sheet bundle in the finisher.
Figure 10B:
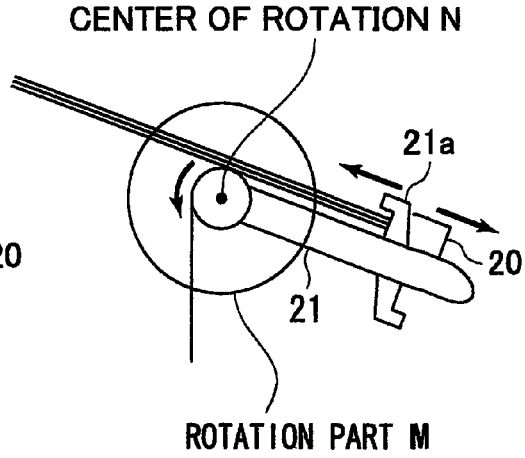

A discharge operation for the sheet bundle in the finisher 1 is explained with reference to FIG. 9 and FIGS. 10A and 10B. When stapling of the sheet bundle is completed, the electromagnetic spring clutch is turned on and driving force is transmitted to the ejectors 20, whereby the ejectors 20 are driven. The bundle pawl belt 21 and the discharge rollers 22 are simultaneously driven. As FIGS. 9A and 9B show, the bundle pawl 21*a* of the bundle pawl belt 21 overtakes the ejectors 20 and receives the sheet bundle from the ejectors 20. The bundle pawl 21*a* catches the sheet bundle and discharges the sheet bundle to the stacking tray 23 in association with the discharge operation of the discharge rollers 22. The bundle pawl 21*a* moves along a curve track, which is away from a center of rotation N by a distance r, in order to return to a home position after the discharge of the sheet bundle. A part in which the pawl bundle 21*a* rotates is defined as "rotation part M".

Figure 11:
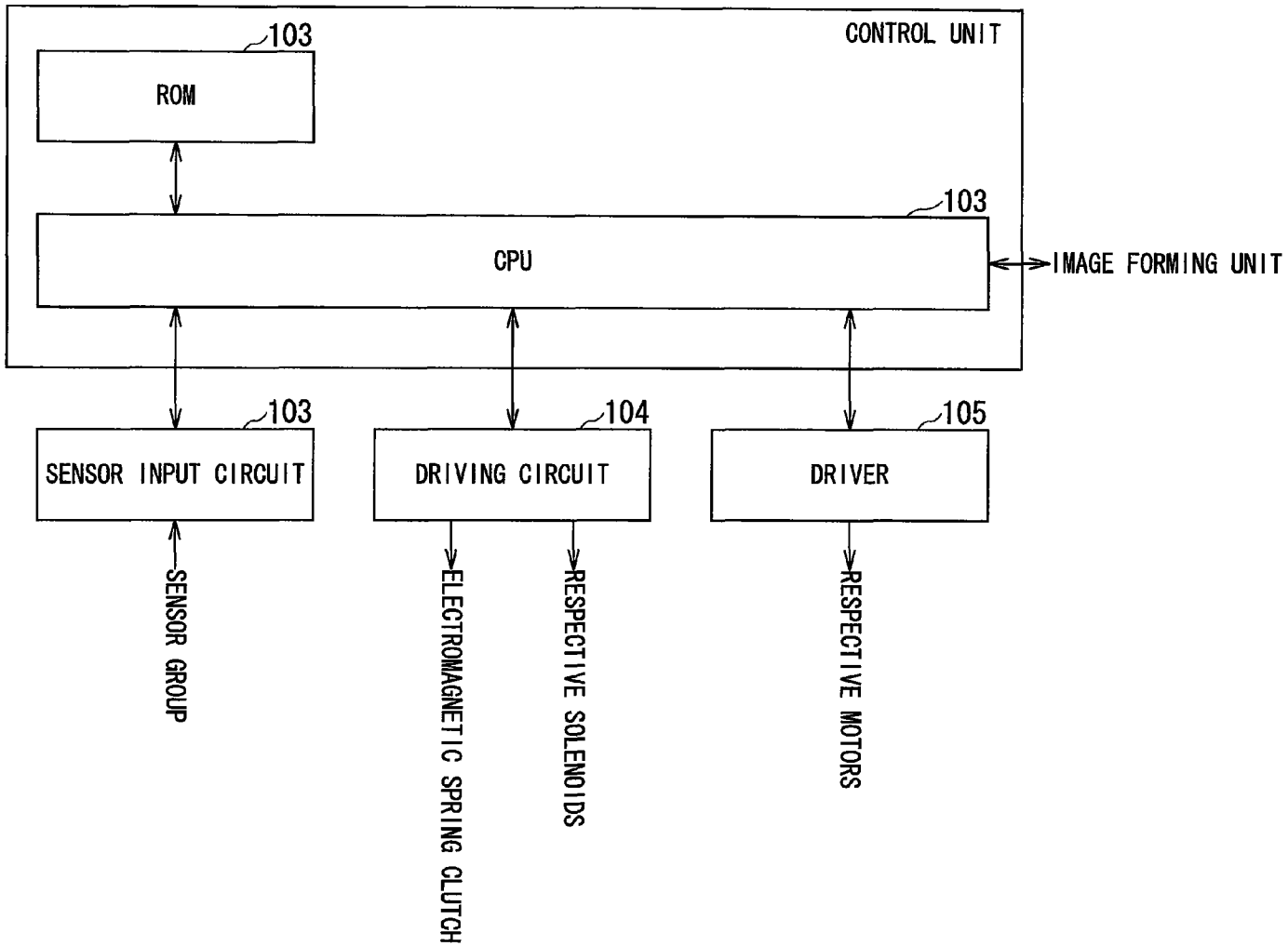
FIG. 11 is a block diagram of a schematic configuration of the inside of a control system of the finisher according to the embodiment.

FIG. 11 is a diagram of a schematic configuration of the inside of a control system of the finisher 1 according to this embodiment. As FIG. 11 shows, the control system of the finisher 1 includes a CPU (Central Processing Unit) 101, a ROM (Read Only Memory) 102, a sensor input circuit 103, a driving circuit 104, and a driver 105. The CPU 101 executes various kinds of processing according to various application programs stored in the ROM 102, generates various control signals, and supplies the control signals to the respective units of the finisher 1 to thereby collectively control the finisher 1. The ROM 102 stores necessary data if the CPU 101 executes the various kinds of processing. The sensor input circuit 103 supplies inputs from a group of various sensors to the CPU 101. The driving circuit 104 switches ON and OFF of various electromagnetic spring clutches according to the control by the CPU 101. The driving circuit 104 drives respective solenoids according to the control by the CPU 101. The driver 105 drives respective motors according to the control by the CPU 101.

The finisher 1 includes the standby trays 13 on an upstream side in a sheet conveying direction of the process tray 14. The standby trays 13 temporarily store one to several sheets discharged from the exit rollers 12*a* and 12*b* while the finisher 1 staples the sheets on the process tray 14. The standby trays 13 temporarily store one to several sheets discharged from the exit rollers 12*a* and 12*b* while the finisher 1 sorts the sheets on the process tray 14. The standby trays 13 include lower standby trays 13-1 and upper standby trays 13-2. When a sheet put on standby on the standby trays 13 is a first sheet, no sheet is put on standby on the lower standby trays 13-1. Therefore, a sheet discharged from the exit rollers 12*a* and 12*b* to the standby trays 13 rubs against the lower standby trays 13-1 made of which has a resin member. However, a coefficient of friction of the lower standby trays 13-1 that rub against the sheet which the exit rollers 12*a* and 12*b* discharge to the standby trays 13 is small. Since the coefficient of friction of the lower standby trays 13 is small, a paper jam less easily occurs.

Figure 12:
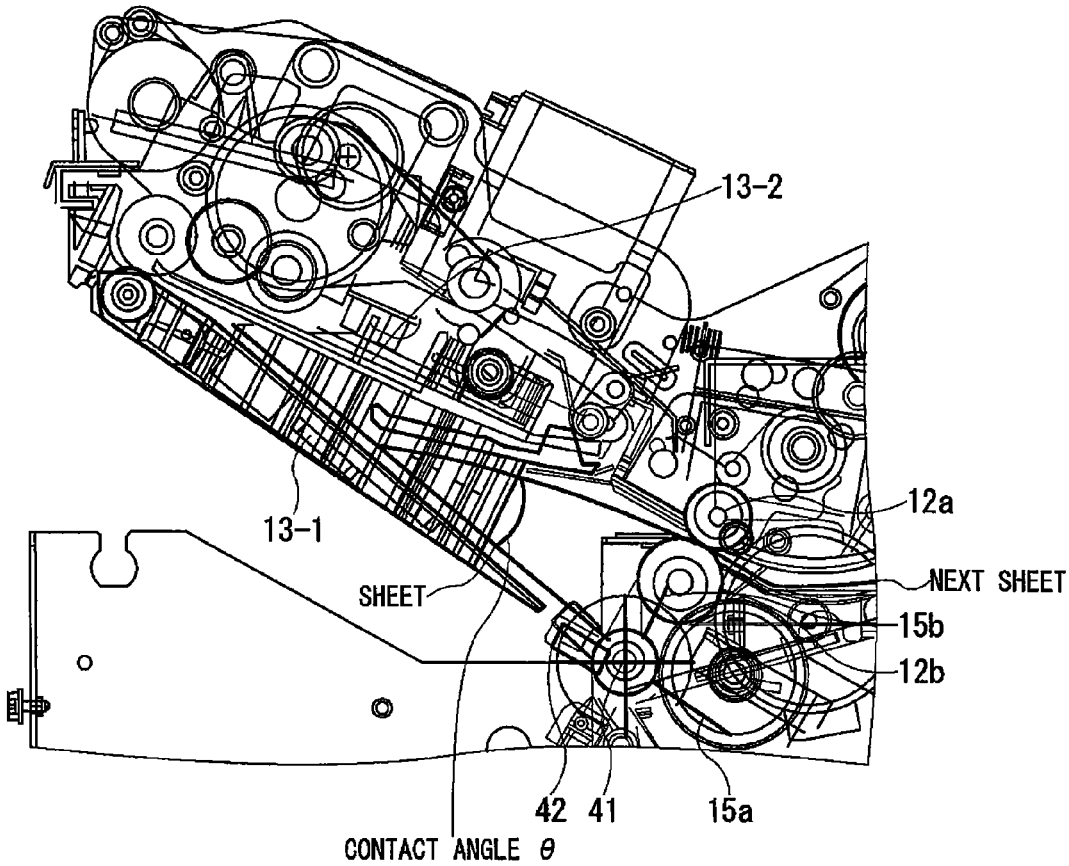
FIG. 12 is a diagram for explaining a paper jam that could occur if a sheet put on standby on the standby trays is a second or subsequent sheet.

As FIG. 12 shows, the finisher 1 has a pedestal 42 that supports the trailing end of a sheet put on standby on the lower standby trays 13-1, in a rotation center shaft 41 as the center in rotating the long paddle 15*a* and the short paddle 15*b*. A stepping motor as a driving unit that rotates the long paddle 15*a*, the short paddle 15*b*, and the pedestal 42 around the axis of the rotation center shaft 41 connects to the rotation center shaft 41.

However, as FIG. 12 shows, if a sheet put on standby on the standby trays 13 is a second or subsequent sheet, a sheet is already put on standby on the lower standby trays 13-1. Therefore, a sheet discharged from the exit rollers 12*a* and 12*b* to the standby trays 13 rubs against the sheet already put on standby on the lower standby trays 13-1. A coefficient of friction of the sheet already put on standby on the lower standby trays 13-1 is larger than the coefficient of friction of the lower standby trays 13-1. If the coefficient of friction of the sheet is large, it is anticipated that a paper jam occurs. Specifically, as FIG. 12 shows, the sheet which the exit rollers 12*a* and 12*b* discharge to the standby trays 13 has a contact angle θ between the sheet and the sheet already put on standby on the lower standby trays 13-1. If the contact angle θ is large, the leading end of the next sheet discharged to the standby trays 13 bends. By bend of the leading end of the sheet, a paper jam may occur. In particular, if a sheet is long in the sheet conveying direction, it is more likely that the sheet bends in the lower standby trays 13-1. If the sheet bends in the lower the standby tray 13-1, the contact angle θ increases and a paper jam tends to occur.

Figure 13:
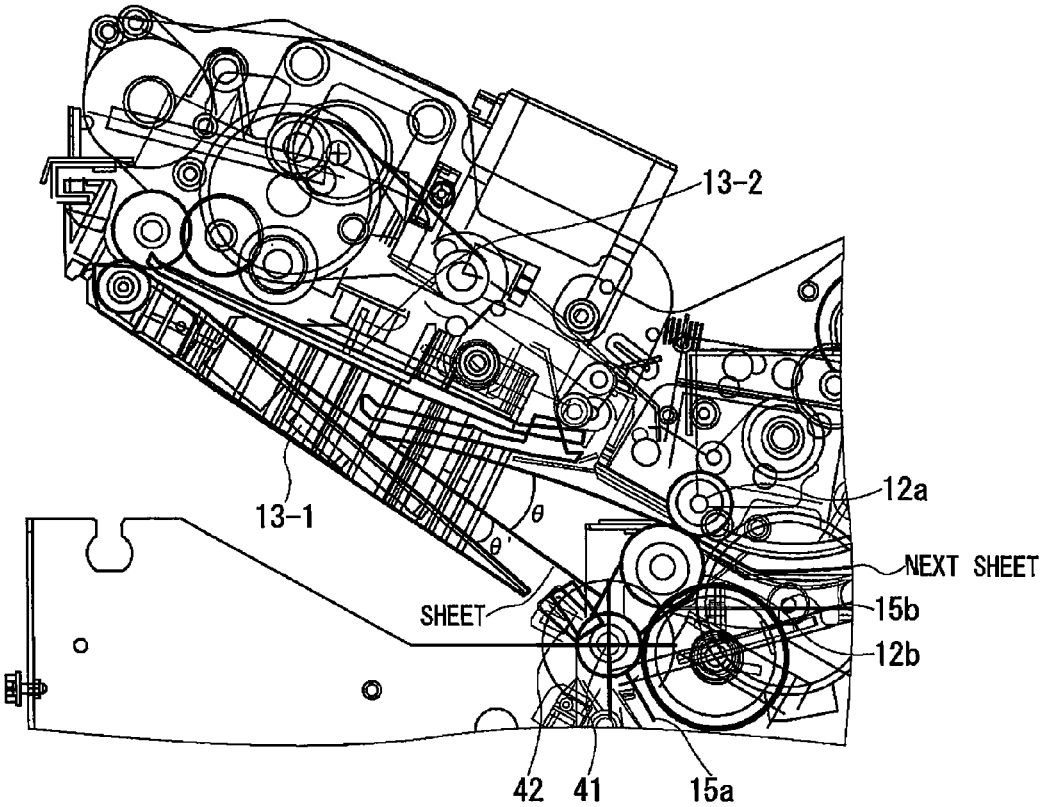
FIG. 13 is a diagram for explaining a method of moving a pedestal position if a sheet put on standby on the standby trays is a second or subsequent sheet in the embodiment.

In this embodiment, as shown in FIG. 13, if a sheet put on standby on the standby trays 13 is a second or subsequent sheet, the control unit 101 rotates the pedestal 42 around the axis of the rotation center shaft 41 using the stepping motor to move the pedestal 42 to a position T2 higher than an initial position Ti of the pedestal 42 used if the first sheet is started to be put on standby on the standby trays 13. This makes it possible to move, according to the movement of the pedestal 42, the trailing end of the sheet put on standby on the lower standby trays 13-1 to nearly the position T2. By moving the trailing end of the sheet, it is possible to reduce the contact angle θ by an angle θ' shown in FIG. 13. The angle θ' increases according to an increase amount of the movement of the position of the pedestal 42. The control unit 101 can control a movement amount of the position of the pedestal 42 by managing a pulse applied to the stepping motor that rotates the paddle 15 and the pedestal 42.

After a last sheet that should be put on standby on the standby trays 13 is put on standby on the lower standby trays 13, the control unit 101 rotates the pedestal 42 around the axis of the rotation center shaft 41 using the stepping motor to move the pedestal 42 from the position T2 to the initial position T1. Thereafter, in order to drop the sheets put on standby on the standby tray 13 onto the process tray 14, the control unit 101 rotates the pedestal 42 and the paddle 15 around the axis of the rotation center shaft 41 using the stepping motor. The finisher 1 performs an aligning operation on the process tray 14. This makes it possible to suitably prevent occurrence of paper jam between the sheets put on standby on the standby trays 13 without occurrence of paper jam, put the sheets on standby and stack the sheets on the standby trays 13, and suitably perform the aligning operation.

The contact angle θ may be changed according to a size of a sheet that enters the standby trays 13. In other words, the contact angle θ may be reduced stepwise according to an increase in a sheet conveyance distance based on a size of a sheet put on standby on the standby trays 13.

Second Embodiment

Figure 14:
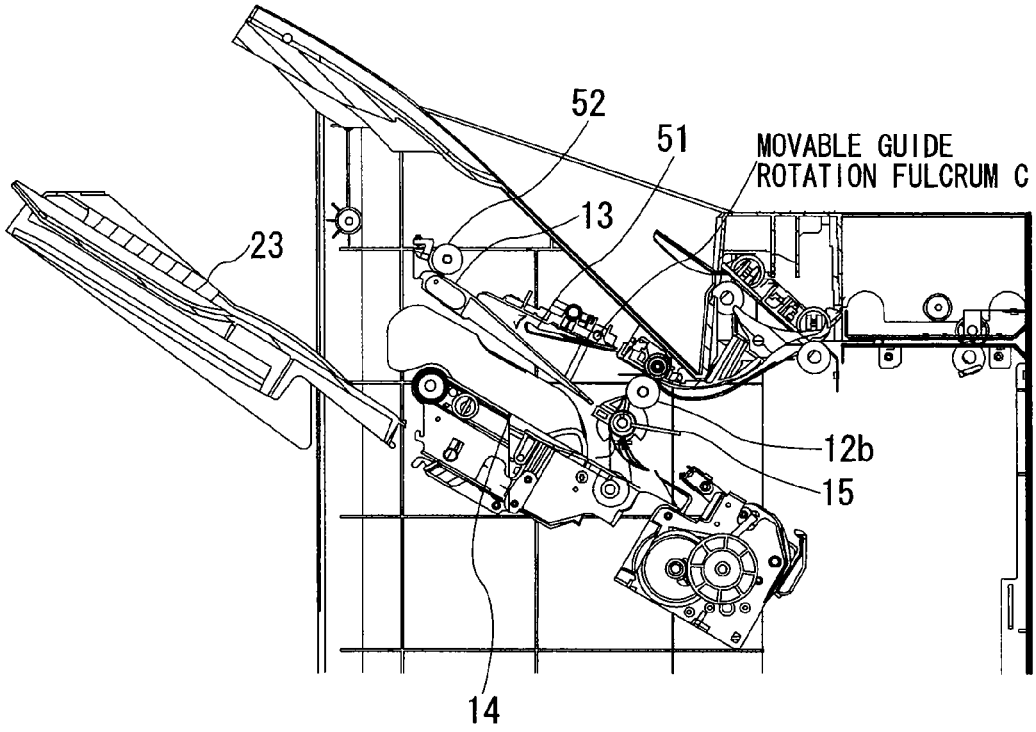
FIG. 14 is a diagram of movable guides provided in the standby trays.

The finisher 1 in the past bends a sheet between the exit rollers 12 (the exit rollers 12*a* and 12*b*) and the pivoting rollers 52 using the movable guides 51 and stacks the sheet and puts the sheet on standby on the standby trays 13. The finisher 1 bends the sheet in order to limit an area above the sheet conveying path because the distance in the height direction of the sheet conveying path is larger than the thickness of the sheet on the standby trays 13. By bend of the sheet, it is possible to fix a conveyance amount of a sheet conveyed to the standby trays 13 and fix a sheet conveyance amount between the exit rollers 12 and the pivoting rollers 52 regardless of whether the sheet conveyed to the standby trays 13 is curled up or down. As FIG. 14 shows, the movable guides 51 can move in an arc shape with a movable guide rotation fulcrum C as a fulcrum.

Figure 15A:
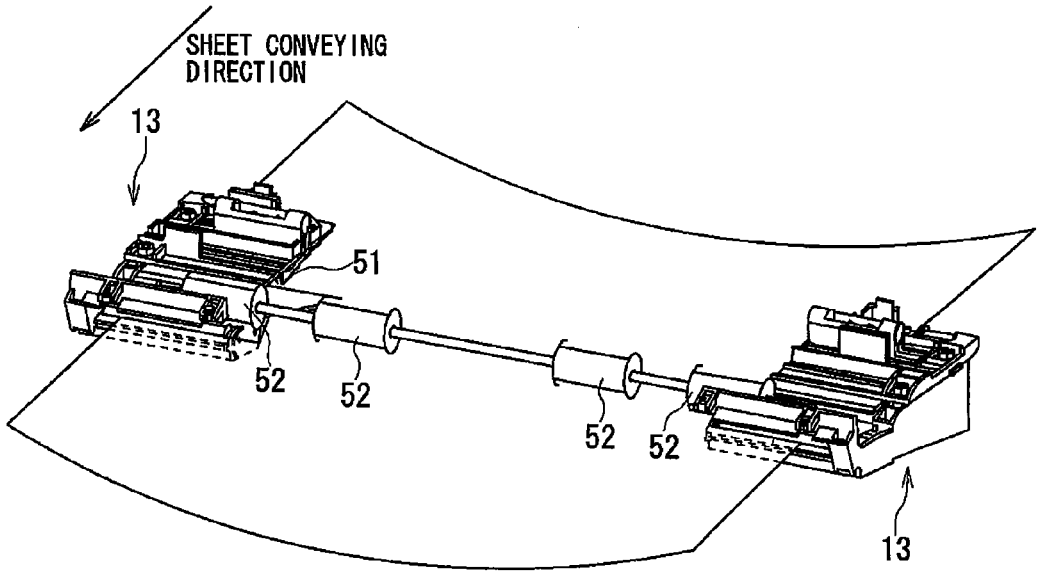
FIGS. 15A and 15B are diagrams of a state in which the finisher stacks a sheet in a V shape and conveyed in a V shape on the standby trays.
Figure 15B:
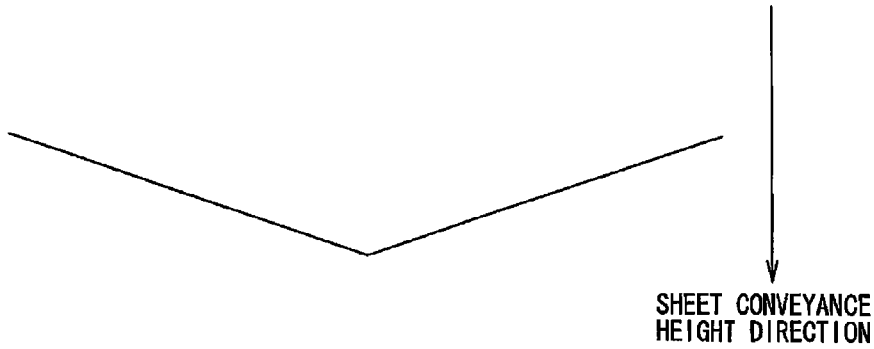

As FIG. 15A shows, two standby tray 13 respectively supports both the ends of the sheet that enters the standby trays 13. However, if the movable guides 51 that limit the area above the sheet conveying path is used, an entrance angle of a sheet entering the standby trays 13 is large compared with an entrance angle at the time when the movable guides 51 are not used. The sheet entering the standby trays 13 may bend in the sheet conveyance height direction because of the gravity. As a result, as FIGS. 15A and 15B shows, the finisher 1 may stack the sheet in a V shape and convey the sheet in a V shape on the standby trays 13.

When the next sheet is buffered in the standby trays 13, if the preceding sheet already put on standby on the standby tray 13 is stacked in a V shape, the next sheet collides with the trailing end of the preceding sheet lifted in a V shape and pushes out the preceding sheet from the standby tray 13. If the preceding sheet already put on standby on the standby tray 13 is stacked in a V shape, a paper jam occurs. When the sheet stacked in a V shape on the standby tray 13 falls onto the process tray 14 keeping a V shape, the paddle 15 collides with the trailing end of the preceding sheet lifted in a V shape. A deficiency occurs in a longitudinal aligning operation by the paddle 15 on the process tray 14.

Figure 16A:
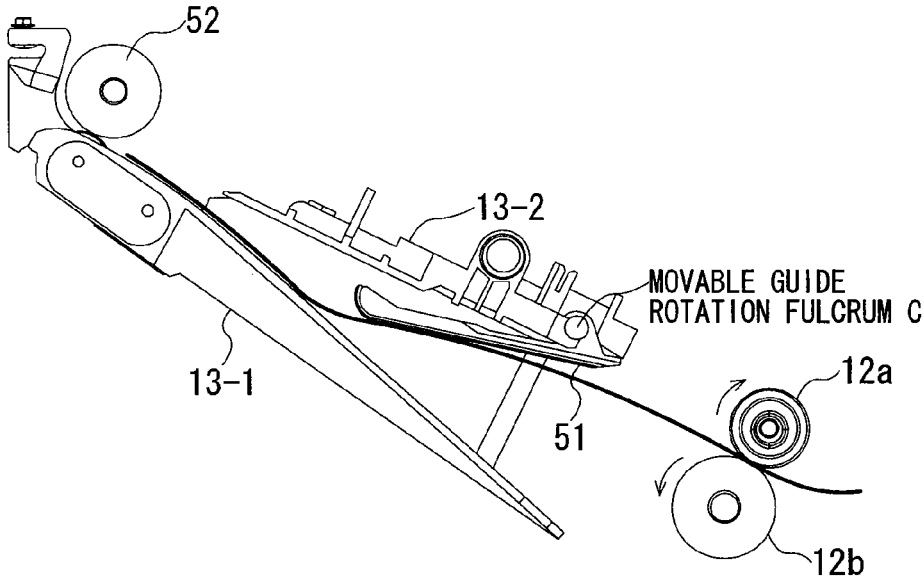
FIGS. 16A and 16B are diagrams of a method of smoothly conveying a sheet in the embodiment.
Figure 16B:
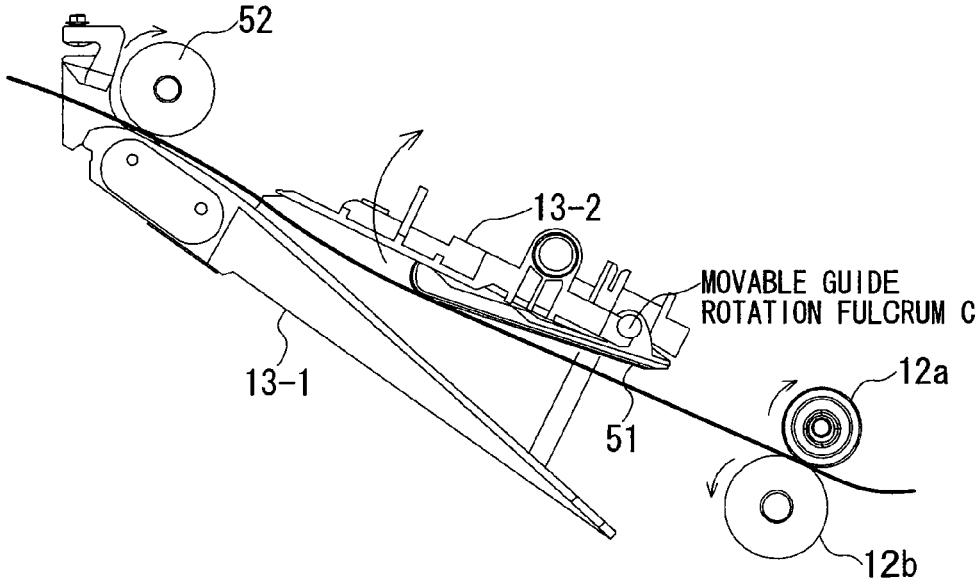
Figure 17:
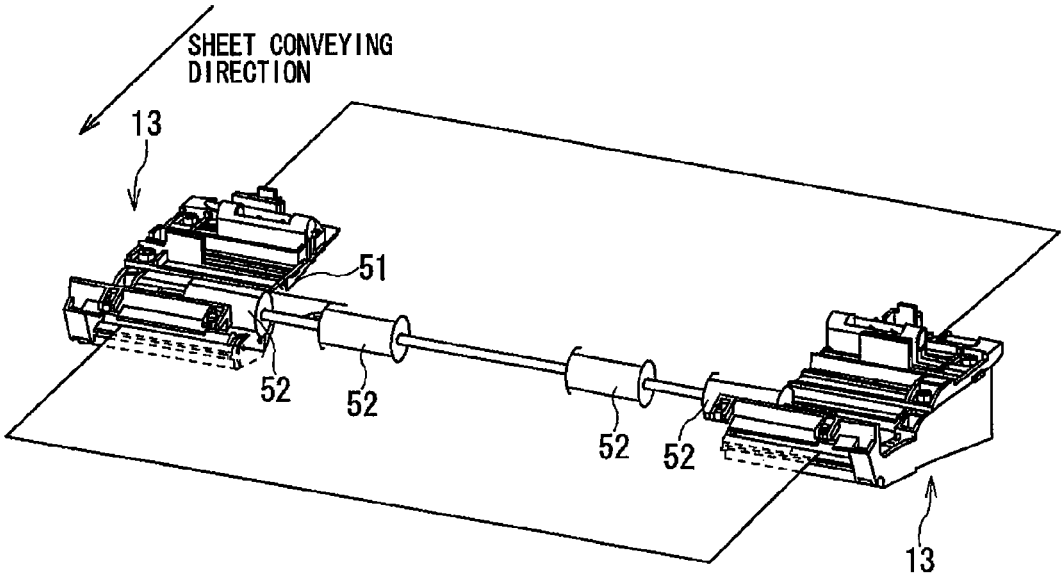
FIG. 17 is a diagram of a state in which the finisher smoothly conveys a sheet on the standby trays.

In this embodiment, as FIG. 16A shows, when a sheet enters the standby trays 13, in order to limit the area above the sheet conveying path, the finisher 1 sets the movable guides 51 in a position where a rotation angle is an angle δ. The finisher 1 bends the sheet between the exit rollers 12 and the pivoting rollers 52 and conveys by the movable guides 51. The exit rollers 12*a* and 12*b* are driven by an exit roller motor which drives the exit roller. Subsequently, as FIG. 16B shows, when the sheet reaches the pivoting rollers 52 in the standby trays 13, the finisher 1 separately controls a pivoting roller motor for driving the pivoting rollers 52 on a downstream side in the sheet conveying direction and an exit roller motor for driving the exit rollers 12*a* and 12*b* on the upstream side in the sheet conveying direction. The finisher 1 sets the number of revolutions of the pivoting rollers 52 is set higher than the number of revolutions of the exit rollers 12*a* and 12*b*. The finisher 1 sets rotating speed of the pivoting rollers 52 higher than rotating speed of the exit rollers 12. The finisher 1 slightly stretches the sheet between the exit rollers 12 and the pivoting rollers 52. The sheet pushes up the movable guides 51 in the sheet conveyance height direction and moves the movable guides 51 in a position where the rotation angle of the movable guides 51 is nearly 0. After the finisher 1 bends and conveys the sheet by the movable guides 51, it is possible to convey the sheet while moving the movable guides 51 in the sheet conveyance height direction. It is possible to prevent the sheet from being stacked in a V shape and conveyed in a V shape on the standby trays 13. As FIG. 17 shows, it is possible to smoothly convey the sheet. It is also possible to smoothly convey the sheet. Therefore, it is possible to prevent the next sheet from colliding with the trailing end of the preceding sheet lifted in a V shape to cause a paper jam. It is possible to prevent the paddle 15 from colliding with the trailing end of the preceding sheet lifted in a V shape and perform the longitudinal aligning operation by the paddle 15 on the process tray 14.

A sheet feeding amount of the pivoting rollers 52 may be set larger than a sheet feeding amount of the exit rollers 12 by setting a roller diameter of the pivoting rollers 52 larger than a roller diameter of the exit rollers 12. This makes it possible to stretch the sheet between the exit rollers 12 and the pivoting rollers 52.

Third Embodiment

Figure 18:
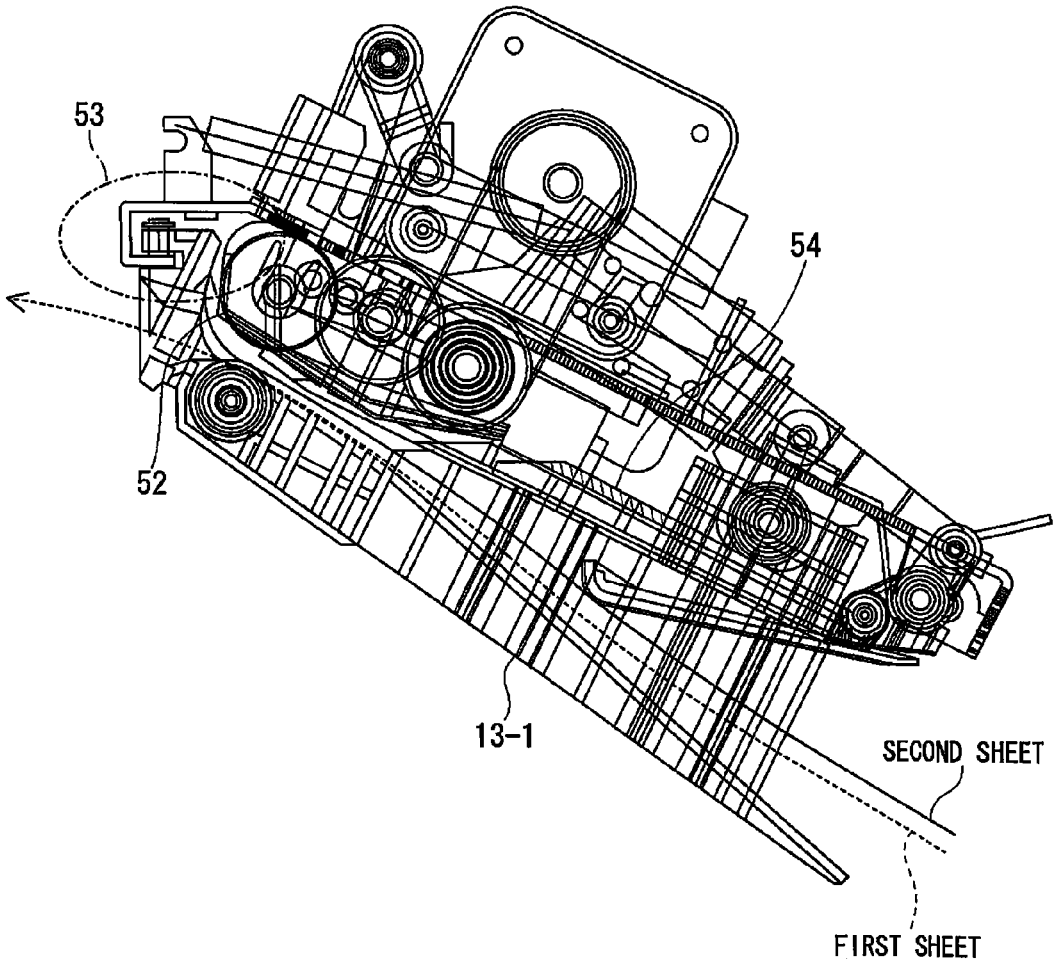
FIG. 18 is a diagram of a state of a paper jam that occurs if the leading end of a sheet enters a space between a slide rail unit and pivoting rollers.

As FIG. 18 shows, the finisher 1 has a slide rail unit 53 that slides the standby trays 13 in order to drop a sheet onto the process tray 14 after putting the sheet on standby on the standby tray 13, in an upper surface section behind the pivoting rollers 52. If the sheet is buffered in the standby trays 13, the pivoting rollers 52 are lifted by a magnet. Therefore, if the sheet is excessively curled up, the leading end of the sheet enters a space between the slide rail unit 53 and the pivoting rollers 52 and a paper jam occurs. FIG. 18 indicates a first sheet buffered in the standby trays 13 by a broken line and a second sheet buffered in the standby trays 13 by a solid line. As FIG. 18 shows, if the second sheet buffered in the standby trays 13 is excessively curled up, the leading end of the second sheet enters the space between the slide rail unit 53 and the pivoting rollers 52. In FIG. 18, the finisher 1 has a tapping arm 54 that taps the sheet downward in order to drop the sheet onto the process tray 14 after putting the sheet on standby on the standby tray 13.

Figure 19:
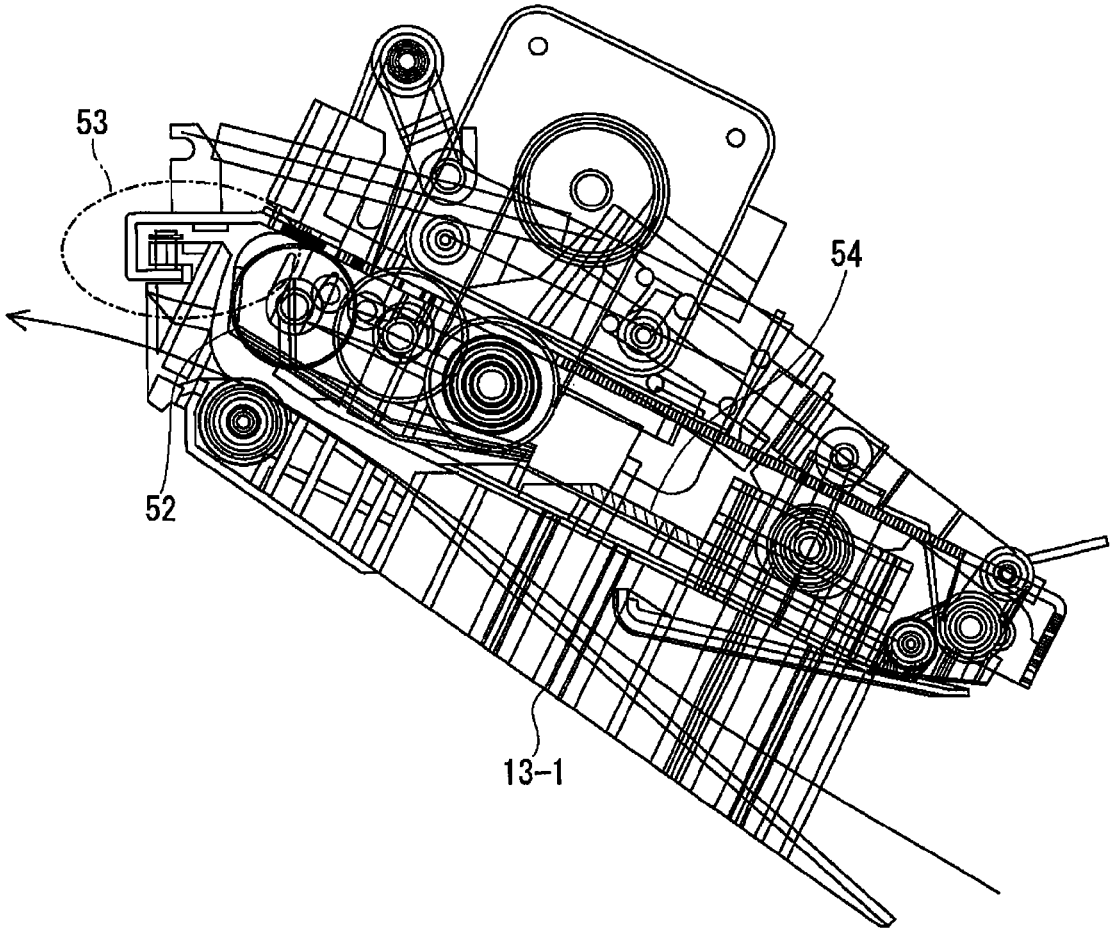
FIG. 19 is a diagram of a state in which, by extending a form of a tapping arm, the finisher prevents the leading end of a second sheet from entering the space between the slide rail unit and the pivoting rollers.
Figure 20:
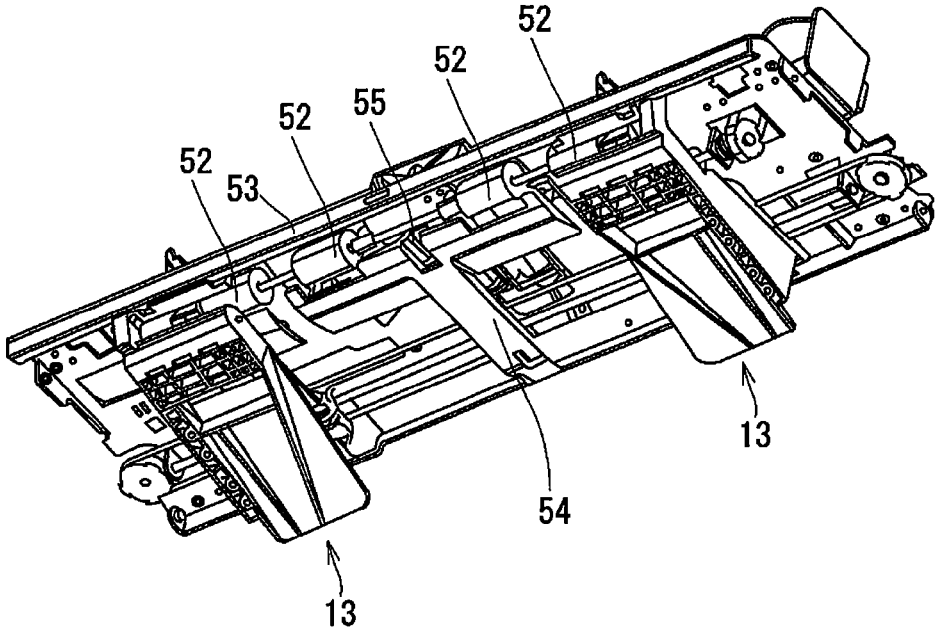
FIG. 20 is a perspective view of the tapping arm.
Figure 21:
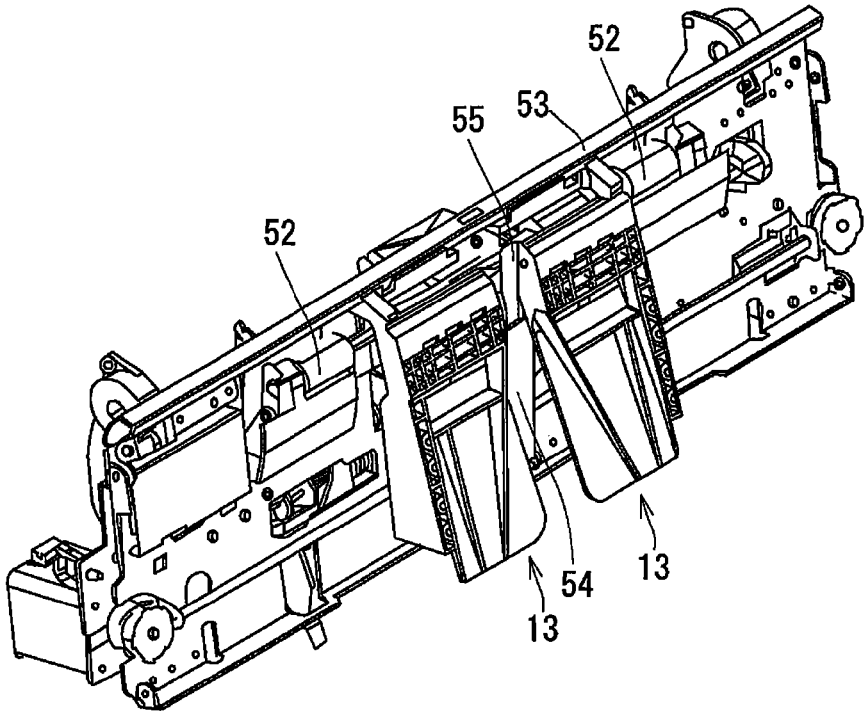
FIG. 21 is another perspective view of the tapping arm.

In this embodiment, as FIG. 19 shows, the leading end of the second sheet is prevented from entering the space between the slide rail unit 53 and the pivoting rollers 52 by extending a form of the tapping arm 54. FIG. 20 is a perspective view of the tapping arm 54. As FIG. 20 shows, the finisher 1 has a tapping arm extending section 55 at the distal end of the tapping arm 54. By the tapping arm extending section 55, it is possible to prevent the leading end of the second sheet from entering the space between the slide rail unit 53 and the pivoting rollers 52. FIG. 20 is another diagram of the tapping arm 54. Rather than providing the tapping arm extending section 55 at the distal end of the tapping arm 54, a guide plate may be provided in the tapping arm 54.

Fourth Embodiment

Figure 22A:
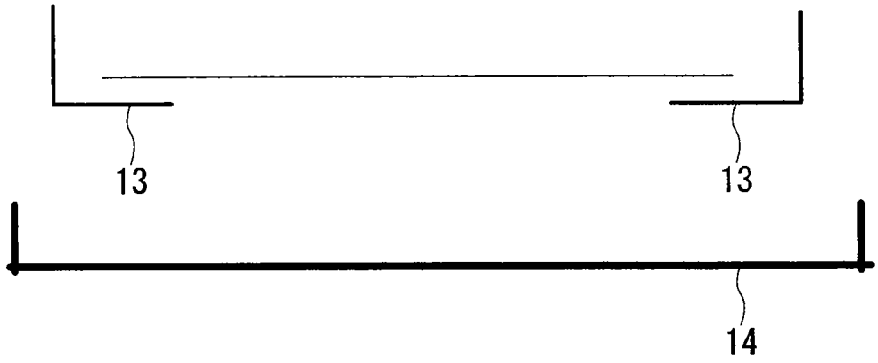
FIGS. 22A to 22C are diagrams of operations of standby trays in the past in the case of active drop.
Figure 22B:
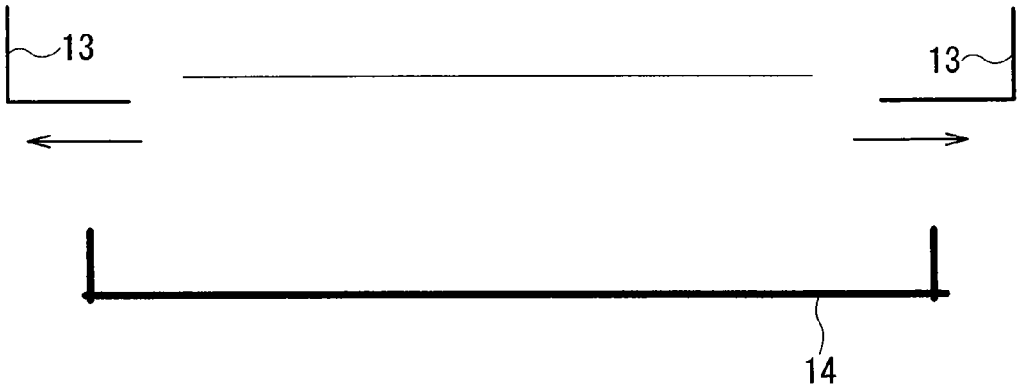
Figure 22C:
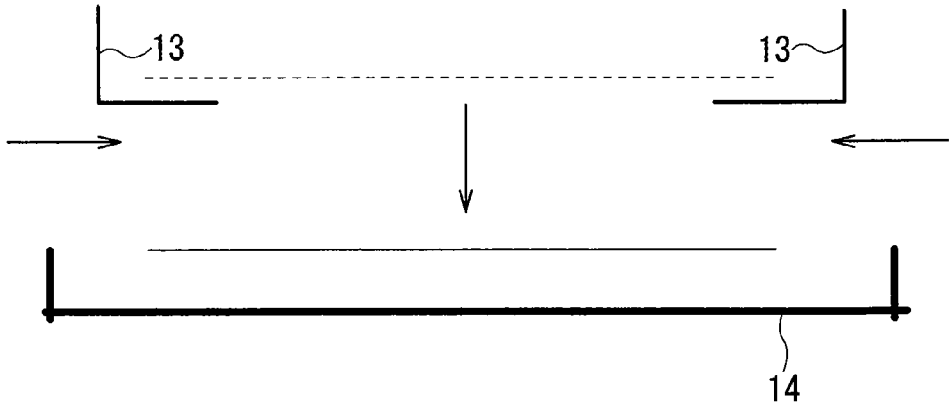

As FIG. 22A shows, the two standby trays 13 put a sheet on standby. When the sheet put on standby on the standby trays 13 is dropped onto the process tray 14, as FIG. 22B shows, the two standby trays 13 are opened and closed in a direction orthogonal to the sheet conveying direction to increase the distance between the two standby trays 13. As FIG. 22C shows, the sheet put on standby on the waiting on the standby trays 13 is active-dropped onto the process tray 14. Thereafter, the distance between the two standby trays 13 increased in the direction orthogonal to the sheet conveying direction is reduced and the two standby trays 13 are reset to initial positions, respectively.

However, if the sheet is active-dropped as FIG. 22C shows, it is necessary to increase the distance between the two standby trays 13 to be equal to or larger than the width of the sheet. The width of a housing of the finisher 1 needs to be at least equal to or larger than width obtained by adding the width of the two standby trays 13 to the increased distance between the two standby trays 13. Lateral alignment plates that align sheets on the process tray 14 in the width direction also operate in the same manner as the operation of the standby trays 13 in the active drop. Therefore, the width of the housing of the finisher cannot be reduced.

In this embodiment, the sheet put on standby on the standby trays 13 is dropped onto the process tray 14 by rotating the two standby trays 13 in the respective initial positions without opening and closing the two standby trays 13 in the active drop. FIGS. 23A to 23F show specific operations of the standby trays 13.

Figure 23A:
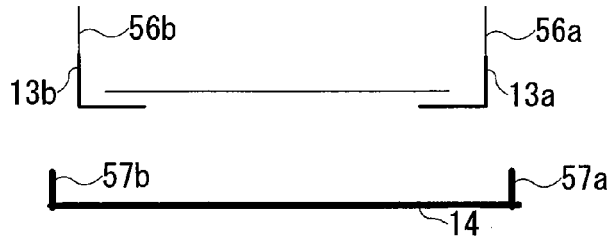
FIGS. 23A to 23F are diagrams of operations of the standby trays in the embodiment in the case of active drop.
Figure 23B:
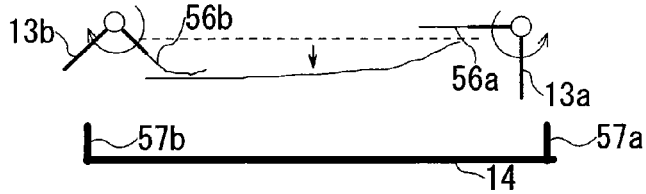
Figure 23C:
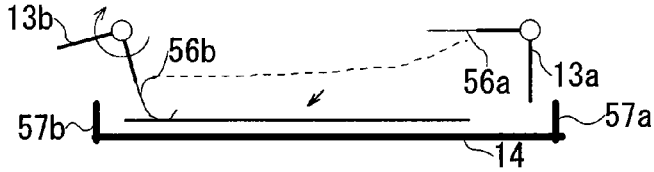

As FIG. 23A shows, two standby trays 13*a* and 13*b* put the sheet on standby. The finisher 1 has a driving unit for rotating the standby tray 13*a*, in the standby tray 13*a*. The finisher 1 has a driving unit for rotating the standby tray 13*b*, in the standby tray 13*b*. The finisher 1 has an elastic paddle 56*a* made of an elastic body, in the standby tray 13*a*. The finisher 1 has an elastic paddle 56*b* made of an elastic body, in the standby tray 13*b*. If the sheet put on standby on the standby tray 13 is dropped onto the process tray 14, as FIG. 23B shows, the standby tray 13*a* rotates 90 degrees to the left and stops. When the standby tray 13 stops, the standby tray 13*b* rotates to the right at a rotation angle larger than 90 degrees. According to the rotation of the standby tray 13*b*, the elastic paddle 56*b* provided in the standby tray 13*b* taps down the sheet onto the process tray 14. As FIG. 23C shows, according to the rotation of the standby tray 13*b*, the elastic paddle 56*b* comes into contact with the sheet dropped onto the process tray 14. Thereafter, according to the rotation of the standby tray 13*b*, the elastic paddle 56*b* pulls the sheet dropped onto process tray 14 to a lateral alignment plate 57*b* side. This makes it easy to laterally align the sheet dropped onto the process tray 14. The standby tray 13*b* rotates nearly 180 degrees. Thereafter, the standby tray 13*b* temporarily stops.

Figure 23D:
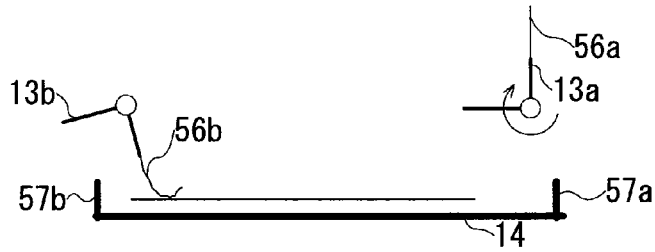
Figure 23E:
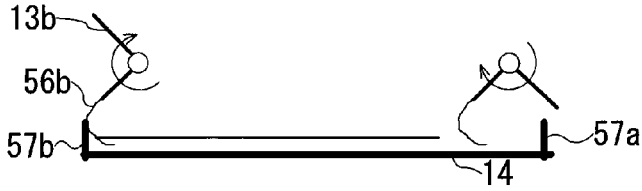
Figure 23F:
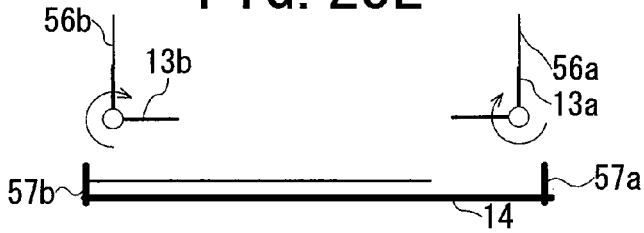

As FIG. 23D shows, the standby tray 13*a* starts to rotate to the right. When the standby tray 13*a* rotates to the right by an angle the same as a rotation angle of the standby tray 13*b* that rotates to the right, the standby tray 13*b* also starts to rotate to the right. As FIG. 23E shows, the elastic paddle 56*a* and the elastic paddle 56*b* move the sheet on the process tray 14 to the lateral alignment plate 57*b* side and strike the sheet against the lateral alignment plate 57*b*. This makes it possible to sort the sheet dropped onto the process tray 14. Thereafter, as FIG. 23F shows, the standby trays 13*a* and 13*b* further rotate to the right and return to the respective initial positions shown in FIG. 23A. The standby trays 13*a* and 13*b* temporarily stop to be synchronized when necessary. However, the standby trays 13*a* and 13*b* may be asynchronously rotated without being stopped. In FIGS. 23A to 23F, the standby tray 13*a* and 13*b* sort the sheet to the lateral alignment plate 57*b* side. However, the standby trays 13*a* and 13*b* may operate oppositely to the operations shown in FIGS. 23A to 23F such that the standby tray 13*a* and 13*b* sort the sheet to the lateral alignment plate 57*a* side.

As explained above, it is possible to drop the sheet onto the process tray 14 and laterally align the sheet without opening and closing the standby trays 13 and the lateral alignment plates 57 in the direction orthogonal to the sheet conveying direction as in the past. Therefore, it is possible to keep the width of the housing of the finisher 1 small.

What is claimed is:

1. A sheet discharging tray comprising:

a discharger configured to discharge a first sheet and a second sheet after the first sheet;

a standby tray configured to temporarily support the second sheet on the first sheet;

a process tray configured to support the first sheet and the second sheet, which are supplied from the standby tray, to be aligned and stapled;

a support configured to support the first sheet on the standby tray; and a controller configured to control the support so that a first angle is smaller than a second angle, the first angle being an angle between the first sheet supported by the support and the second sheet discharged to the standby tray, the second angle being an angle between the second sheet and the standby tray, wherein the controller is configured to change the first angle according to a size of the second sheet supported by the standby tray and make the first angle smaller stepwise, according to an increase in a sheet conveyance distance based on the size of the second sheet supported by the standby tray.

2. The sheet discharging tray according to claim 1, further comprising a driving unit configured to pivot the support, wherein the controller pivots the support by using the driving unit and controls the support so that the first angle is smaller than the second angle.

3. The sheet discharging tray according to claim 2, wherein the controller pivots the support by using the driving unit and moves the support to a position higher than a position where the support is set if the first sheet is supported by the standby tray.

4. The sheet discharging tray according to claim 3, wherein the controller moves one end of the first sheet supported by the support in accordance with a pivot amount of the support pivoted by the driving unit and controls the support so that the first angle is smaller than the second angle.

5. The sheet discharging tray according to claim 1, wherein the controller controls the support so that the first angle is smaller than the second angle, from a time when the second sheet is supported by the standby tray until a last sheet is supported by the standby tray.

6. The sheet discharging tray according to claim 5, wherein the controller resets the support to a position where the support is set if the first sheet is supported by the standby tray.

7. An image forming apparatus including a sheet discharging tray, the sheet discharging tray comprising:

a discharger configured to discharge a first sheet and a second sheet after the first sheet;

a standby tray configured to temporarily support the second sheet on the first sheet;

a process tray configured to support the first sheet and the second sheet, which are supplied from the standby tray, to be aligned and stapled;

a support configured to support the first sheet on the standby tray; and a controller configured to control the support so that a first angle is smaller than a second angle, the first angle being an angle between the first sheet supported by the support and the second sheet discharged to the standby tray, the second angle being an angle between the second sheet and the standby tray, wherein the controller is configured to change the first angle according to a size of the second sheet supported by the standby tray and make the first angle smaller stepwise, according to an increase in a sheet conveyance distance based on the size of the second sheet supported by the standby tray.

8. The image forming apparatus according to claim 7, further comprising a driving unit configured to pivot the support, wherein the controller pivots the support by using the driving unit and controls the support so that the first angle is smaller than the second angle.

9. The image forming apparatus according to claim 8, wherein the controller pivots the support by using the driving unit and moves the support to a position higher than a position where the support is set if the first sheet is supported by the standby tray.

10. The image forming apparatus according to claim 9, wherein the controller moves one end of the first sheet supported by the support in accordance with a pivot amount of the support pivoted by the driving unit and controls the support so that the first angle than is smaller the second angle.

11. The image forming apparatus according to claim 7, wherein the controller controls the support so that the first angle is smaller than the second angle, from a time when the second sheet is supported by the standby tray until a last sheet is supported by the standby tray.

12. The image forming apparatus according to claim 11, wherein the controller resets the support to a position where the support is set if the first sheet is supported by the standby tray.

* * * * *